US006969223B2

(12) United States Patent
Tolmon et al.

(10) Patent No.: US 6,969,223 B2
(45) **Date of Patent: *Nov. 29, 2005**

(54) PIPE HANDLING APPARATUS

(75) Inventors: E. Kent Tolmon, Lindsay, OK (US); Ronald D. Jones, Lindsay, OK (US)

(73) Assignee: Hydra-Walk, Inc., Lindsey, OK (US)

( * ) Notice: Subject to any disclaimer, the term of this patent is extended or adjusted under 35 U.S.C. 154(b) by 3 days.

This patent is subject to a terminal disclaimer.

(21) Appl. No.: 10/818,575

(22) Filed: Apr. 6, 2004

(65) Prior Publication Data

US 2004/0197166 A1 Oct. 7, 2004

Related U.S. Application Data

(63) Continuation of application No. 10/389,026, filed on Mar. 14, 2003, now Pat. No. 6,719,515, which is a continuation of application No. 09/620,580, filed on Jul. 20, 2000, now Pat. No. 6,533,519.

(51) Int. Cl.[7] ..... E21B 19/00
(52) U.S. Cl. ..... 414/22.54; 414/22.57
(58) Field of Search ..... 414/22.54, 22.57, 414/22.58, 22.59, 22.61, 22.62; 175/85

(56) References Cited

U.S. PATENT DOCUMENTS

| | | | | |
|---|---|---|---|---|
| 3,254,776 | A | 6/1966 | Brown | |
| 3,650,339 | A | 3/1972 | Selfe et al. | 173/196 |
| 3,706,347 | A | 12/1972 | Brown | 173/164 |
| 3,780,883 | A | 12/1973 | Brown | 214/2.5 |
| 3,916,500 | A | 11/1975 | Brown | 29/240 |
| 4,021,978 | A | 5/1977 | Busse et al. | 52/118 |
| 4,053,063 | A | 10/1977 | Harper, Jr. | 214/2.5 |
| 4,067,453 | A | 1/1978 | Moller | |
| 4,074,792 | A | 2/1978 | Zaugg et al. | 182/117 |

(Continued)

*Primary Examiner*—Donald P Walsh
*Assistant Examiner*—Jeffrey A. Shapiro
(74) *Attorney, Agent, or Firm*—Dunlap, Codding & Rogers, P.C.

(57) ABSTRACT

A pipe handling apparatus for transporting pipe between a position adjacent a pipe storage rack and a rig floor elevated above the pipe storage rack is provided. The pipe handling apparatus includes a support frame, substantially horizontally disposed platform supported by the support frame having a pipe receiving groove formed therein for receiving the joint of pipe, a carriage member, and a pusher member. The carriage member is movable from a lowered position wherein the joint of pipe which is positioned in the pipe receiving groove of the platform is supported in a substantially horizontal position and a raised position wherein the carriage member supports a first end of the joint of pipe at an elevated position relative to an opposed second end of the joint of pipe. The pusher member is movable along the pipe receiving groove between a retracted position and an extended position. In the retracted position, the pusher member is positioned near the second end of the pipe receiving groove to laterally support the joint of pipe when the first end of the joint of pipe is elevated relative to the second end. In the extended position, the pusher member is moved a selected distance away from the second end of the pipe receiving groove toward the first end of the pipe receiving groove so as to cause the second end of the joint of pipe to move through the pipe receiving groove towards the first end of the pipe receiving groove along a substantially horizontal plane and thereby cause the first end of the joint of pipe to be moved to a position overlying the rig floor.

18 Claims, 6 Drawing Sheets

U.S. PATENT DOCUMENTS

| | | | | |
|---|---|---|---|---|
| 4,235,566 | A | 11/1980 | Beeman et al. | 414/22 |
| 4,366,591 | A | 1/1983 | Zimmerman | 14/71.3 |
| 4,372,420 | A | 2/1983 | White | 181/120 |
| 4,373,420 | A | 2/1983 | Piesik | 89/1.812 |
| 4,386,883 | A | 6/1983 | Hogan et al. | 414/22 |
| 4,403,898 | A | 9/1983 | Thompson | 414/22 |
| 4,426,182 | A | 1/1984 | Frias et al. | 414/22 |
| 4,453,872 | A | 6/1984 | Frias et al. | 414/22 |
| 4,474,520 | A | 10/1984 | Buckner et al. | 414/22 |
| 4,486,137 | A | 12/1984 | Buckner | 414/22 |
| 4,552,498 | A | 11/1985 | Dysarz | 414/22 |
| 4,828,050 | A | 5/1989 | Hashimoto | 175/45 |
| 4,951,759 | A | 8/1990 | Richardson | 175/85 |
| 5,127,790 | A | 7/1992 | Teague | 414/786 |
| 5,183,282 | A | 2/1993 | Smyly | 114/344 |
| 5,451,129 | A | 9/1995 | Boyadjieff et al. | |
| 6,079,925 | A | 6/2000 | Morgan et al. | 414/22.57 |
| 6,227,537 | B1 | 5/2001 | Schmid | 182/143 |
| 6,533,519 | B1 * | 3/2003 | Tolmon et al. | 414/22.54 |
| 6,719,515 | B2 * | 4/2004 | Tolmon et al. | 414/22.54 |

* cited by examiner

PIPE HANDLING APPARATUS

CROSS-REFERENCE TO RELATED APPLICATIONS

This application is a continuation of U.S. Ser. No. 10/389,026, filed Mar. 14, 2003 now U.S. Pat. No. 6,719,515 which is a continuation of U.S. Ser. No. 09/620,580, filed Jul. 20, 2000, now U.S. Pat. No. 6,533,519.

BACKGROUND OF THE INVENTION

1. Field of the Invention

The present invention relates generally to materials lifting apparatuses, and more particularly, but not by way of limitation, to an improved pipe handling apparatus for transporting pipe between a pipe storage rack and a rig floor which is elevated above the pipe storage rack.

2. Brief Description of the Related Art

In the drilling of a well, tubular members such as drill pipe, casing, and production tubing must be transported between a pipe storage rack and a drilling rig floor. For instance, it is necessary periodically to pull the drill string out of the well bore ("tripping out") to replace the drill bit and in turn run the drill string back into the well bore. This process involves a series of repetitive steps in which joints of pipe are withdrawn from the well bore, disconnected, and stored on the pipe storage rack. The process is then repeated in reverse order to replace the drill string in the well bore. Due to the fact that the drilling rig floor can be as much as 20 to 30 feet above ground level, numerous devices have been previously proposed to assist in the movement of the tubular members between the pipe storage rack and the rig floor. Such devices are generally complex in construction, designed for use with a particular drilling rig, and not easily transported from one drilling rig to another.

As with the drilling process, the servicing of a well involves a series of repetitive steps to replace production tubing or maintenance downhole equipment. Rigs used for servicing wells are often referred to as "workover" rigs. Workover rigs generally have a rig floor positionable over the surface equipment of the well and a mast which supports the elevators. The elevators are used to raise and lower the production tubing into and out of the well bore and to handle the individual joints of pipe once they are on the rig floor.

The rig floor of a workover rig can be elevated as much as 6 to 15 feet above ground level depending on the amount of surface equipment utilized with the well. However, unlike with drilling rigs, it has been the practice to manually transport the pipe between the rig floor and the pipe rack. This involves a worker rolling a joint of pipe off the pipe rack onto a platform known as a "catwalk." The worker then drags the pipe toward the rig and raises one end of the pipe toward the rig floor to the point where the elevators of the rig can latch onto the end of the pipe. The process is reversed when removing pipe from the rig. This practice is extremely labor intensive, time consuming, and dangerous.

To this end, a need exists for an improved pipe handling apparatus which is simple in construction, easy to transport and operate, and which is adapted to be used with a variety of different rigs. It is to such an apparatus that the present invention is directed.

BRIEF SUMMARY OF THE INVENTION

The present invention is directed to a pipe handling apparatus for transporting a joint of pipe between a position adjacent a pipe storage rack and a rig floor elevated above the pipe storage rack. The pipe handling apparatus includes a support frame, a horizontally disposed platform, a carriage member, and a pusher member. The platform has a pipe receiving groove formed therein for receiving the joint of pipe. The pipe receiving groove has a first end and an opposing second end.

The carriage member is positioned near the first end of the pipe receiving groove and is connected to the support frame. The carriage member is movable from a lowered position wherein the joint of pipe which is positioned in the pipe receiving groove of the platform is supported in a substantially horizontal position and a raised position wherein the carriage member supports a first end of the joint of pipe at an elevated position relative to an opposed second end of the joint of pipe. The elevated position of the first end of the joint of pipe is at a height at least the height of the rig floor while the second end of the joint of pipe remains positioned in the pipe receiving groove.

The pusher member is in alignment with the pipe receiving groove so as to be engageable with the second end of the joint of pipe when the joint of pipe is positioned in the pipe receiving groove. The pusher member is movable along the pipe receiving groove between a retracted position and an extended position. In the retracted position, the pusher member is positioned near the second end of the pipe receiving groove to laterally support the joint of pipe when the first end of the joint of pipe is elevated relative to the second end. In the extended position, the pusher member is moved a selected distance away from the second end of the pipe receiving groove toward the first end of the pipe receiving groove so as to cause the second end of the joint of pipe to move through the pipe receiving groove towards the first end of the pipe receiving groove along a substantially horizontal plane and thereby cause the first end of the joint of pipe to be moved to a position overlying the rig floor.

The features and advantages of the present invention will become apparent from the following detailed description when read in conjunction with the accompanying drawings and appended claims.

DETAILED DESCRIPTION OF THE INVENTION

Figure 1:
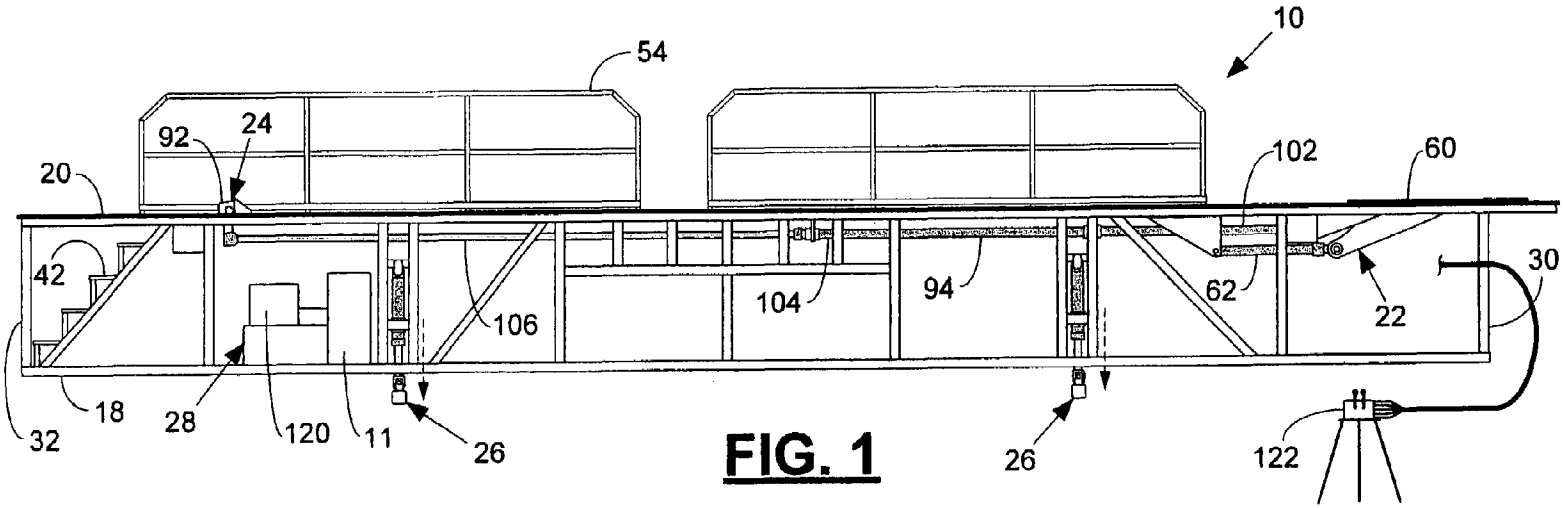
FIG. 1 is a side elevational view of a pipe handling apparatus constructed in accordance with the present invention having a carriage member shown in a lowered position.

Referring now to the drawings and more particularly to FIGS. 1–5, a pipe handling apparatus 10 constructed in accordance with the present invention is shown. The pipe handling apparatus 10 adapted to be positioned adjacent a pipe storage rack 12 (FIG. 3) for facilitating the transport of a joint of pipe 14 between the pipe storage rack 12 and a rig floor 16 (FIGS. 3 and 5) which is typically elevated a distance above the pipe storage rack 12. The pipe handling apparatus 10 includes a support frame 18, a platform 20, a carriage assembly 22, a pusher assembly 24, a pair of jack assemblies 26, and a hydraulic assembly 28.

The support frame 18 is an elongated rectangular structure having a first end 30, a second end 32, a first side 34, a second side 36, an upper side 38, and a lower side 40. The support frame 18 is constructed of a plurality of rigid tubular members interconnected to one in a suitable manner, such as by welding. The support frame 18 is provided with a stairway 42 to facilitate a worker's movement between the upper side 38 and the lower side 40 of the support frame 18.

Figure 8:
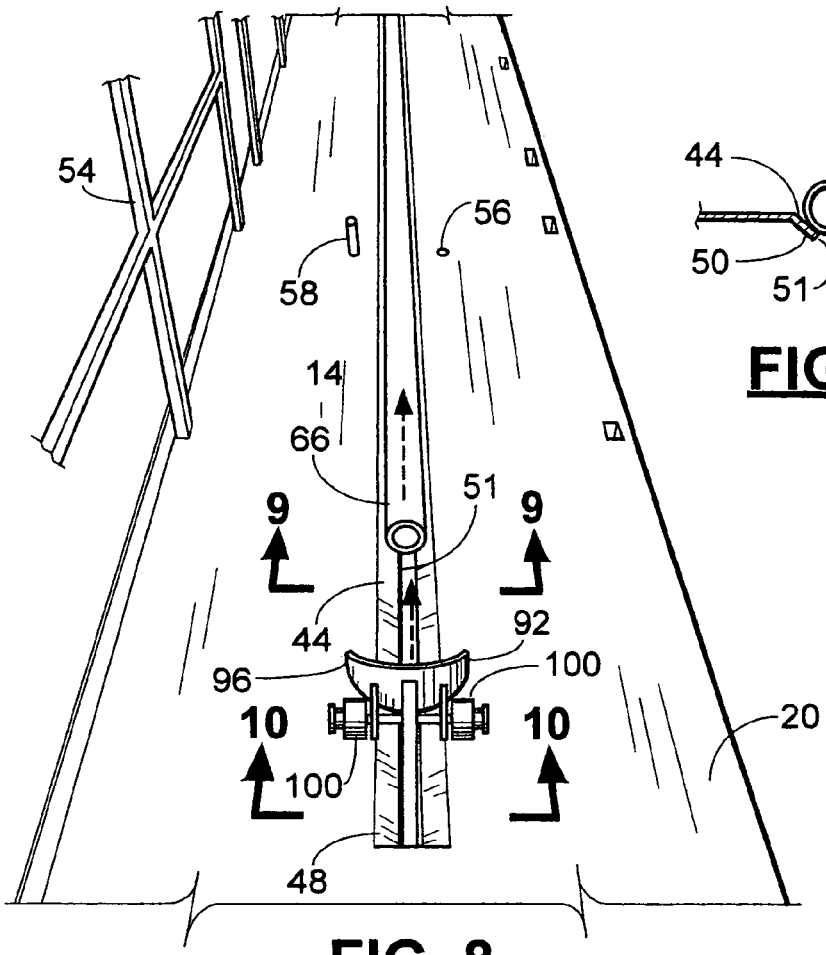
FIG. 8 is a perspective view of a portion of the platform and a pusher assembly.
Figure 9:
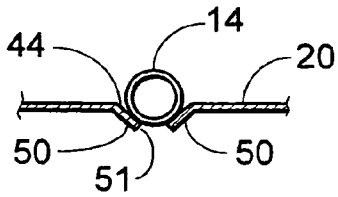
FIG. 9 is a cross sectional view taken along line 9—9 of FIG. 8.
Figure 10:
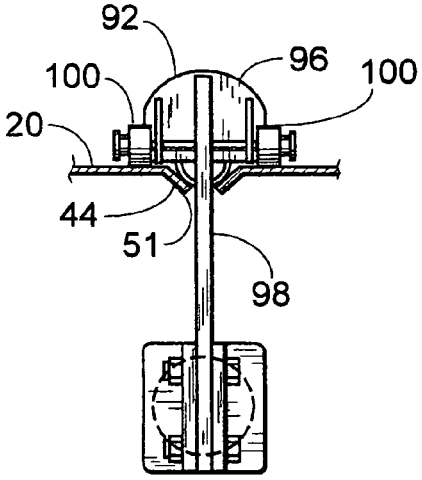
FIG. 10 is a cross sectional view taken along line 10—10 of FIG. 8 showing an end view of the pusher assembly.
Figure 11:
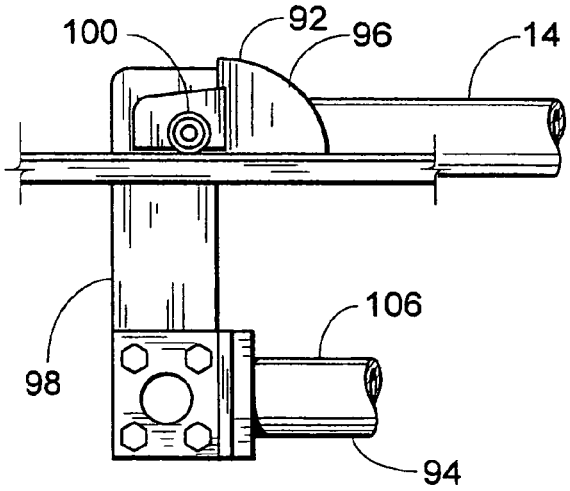
FIG. 11 is a side elevational view of the pusher assembly.

The platform 20 is secured to the upper side 38 of the support frame 18 so that the platform 20 is substantially horizontally disposed when the pipe handling apparatus 10 is in use. As best shown in FIGS. 8–10, the platform 20 is provided with a longitudinally extending pipe receiving groove 44. As shown in FIGS. 8 and 9, the pipe receiving groove 44 is configured to hold the joint of pipe 14 to be transported to the rig floor 16.

Figure 6:
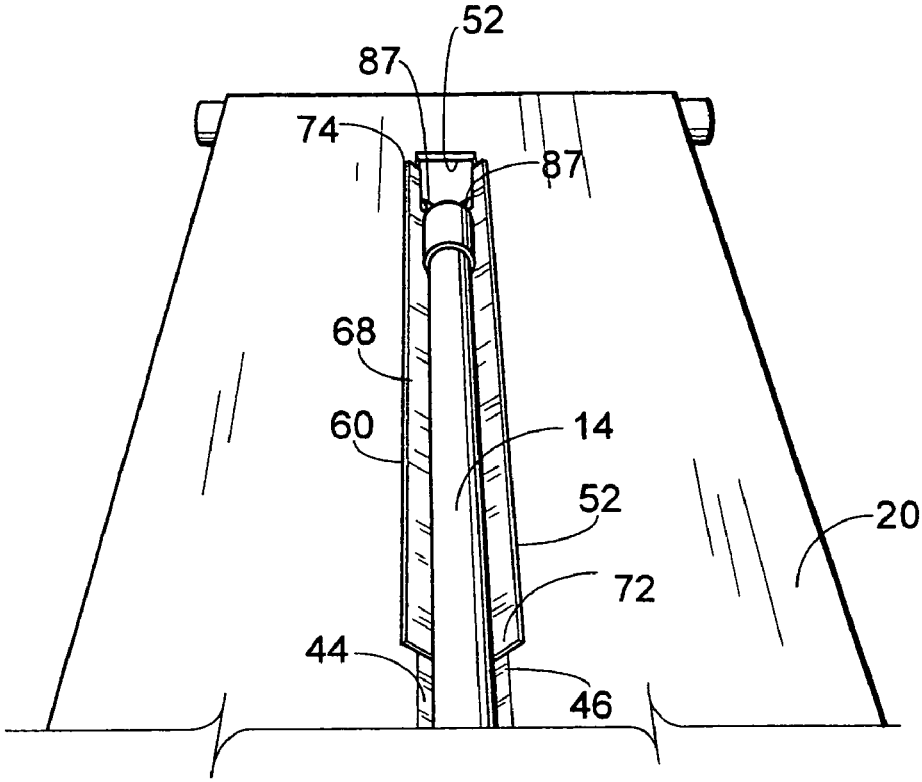
FIG. 6 is a perspective view of a first end of the platform and the carriage member shown in the lowered position.
Figure 7:
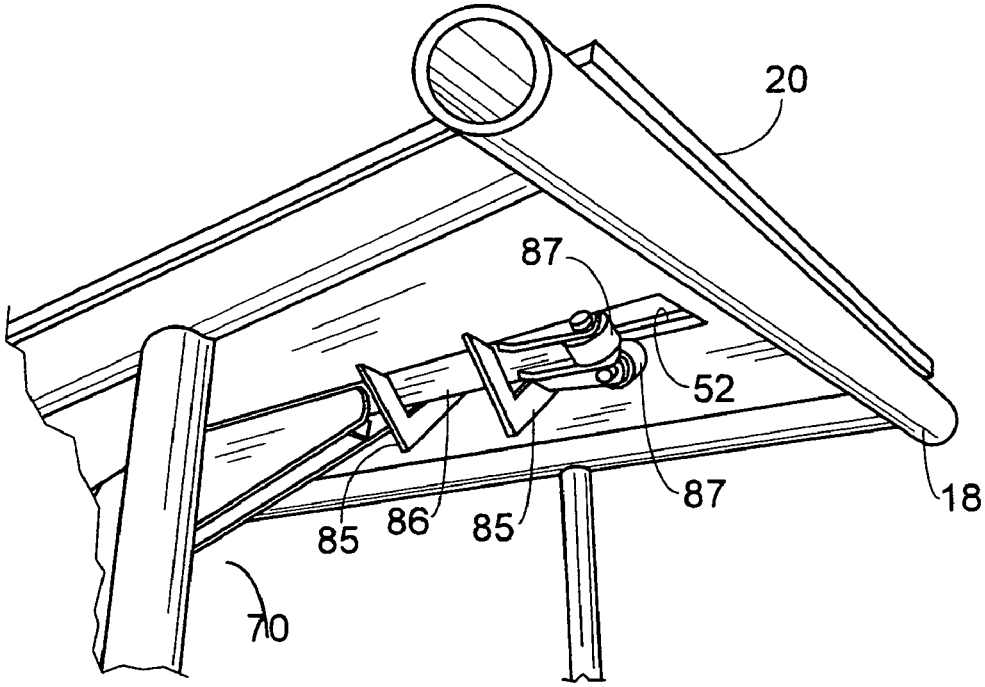
FIG. 7 is a perspective view of a lower portion of the platform showing the carriage assembly in the lowered position.

The pipe receiving groove 44 has a first end 46 (FIG. 6) and an opposing second end 48 (FIG. 8) and is formed by angling opposing portions 50 of the platform 20 in a downward direction (FIG. 9). The platform 20 further includes an elongated slot 51 extending through the platform 20 and running the length of the pipe receiving groove 44. The slot 44 is defined by the downwardly angled portions 50 of the platform 20. As shown in FIG. 6, the platform 20 is provided with an elongated opening 52 in communication with the first end 46 of the pipe receiving groove 44 for receiving a portion of the carriage assembly 22 in a manner to be discussed below.

Returning to FIGS. 1, 2 and 8, the platform further includes a hand rail 54 which is adapted to be positioned on either side of the platform 20, and the platform includes a plurality of holes 56 on either side of the pipe receiving groove 44 for positioning a pair of stop members 58 (only one shown in FIG. 8) adjacent the pipe receiving groove 44 of the platform 20 for preventing the joint of pipe 14 from rolling through the pipe receiving groove 44 and across the platform 20.

Referring now to FIGS. 4–7, the carriage assembly 22 includes a carriage member 60 and a cylinder 62. The carriage member 60 is secured to the support frame 18 such that the carriage member 60 is positioned near the first end 46 of the pipe receiving groove 44 within the opening 52 of the platform 20. The cylinder 62 functions to move the carriage member 60 from a lowered position (FIGS. 1, 6, and 7) wherein the joint of pipe 14 which is positioned in the pipe receiving groove 44 of the platform 20 is supported in a substantially horizontal position and a raised position (FIGS. 2, 4, and 5) wherein the carriage member 60 supports a first end 64 of the joint of pipe 14 at an elevated position relative to an opposing second end 66 of the joint of pipe 14 while the second end 66 of the joint of pipe 14 remains positioned in the pipe receiving groove 44.

The carriage member 60 includes a V-shaped trough portion 68 which is positioned within the opening 52 of the platform 20 and configured to substantially correspond with the shape and size of the pipe receiving groove 44 such that the upper surface of the trough portion 68 functions as an extension of the pipe receiving groove 44 when the carriage member 60 is in the lowered postion. The carriage member 60 further includes a bracket portion 70 extending from the lower side of the trough portion 680.

Figure 5:
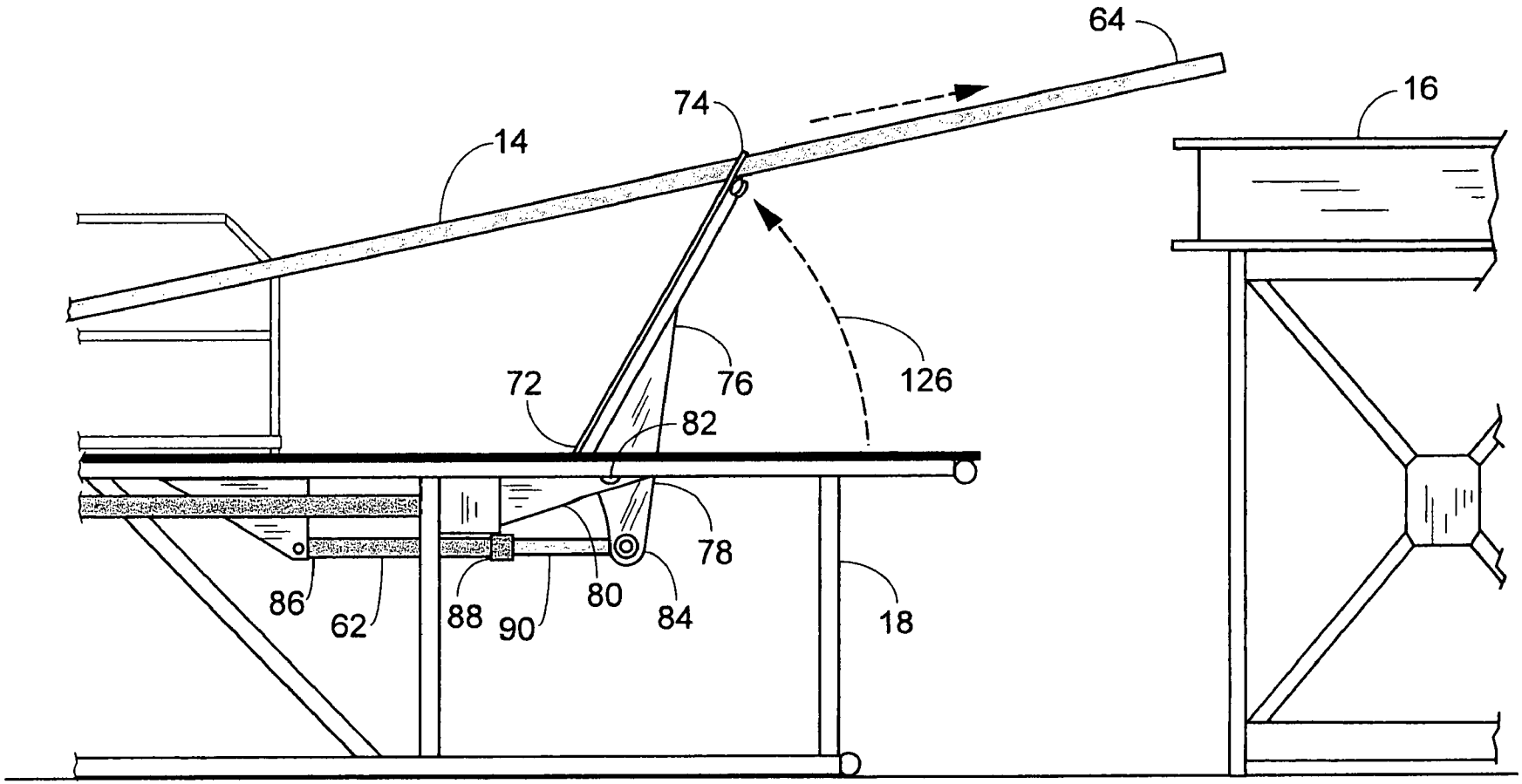
FIG. 5 is a side elevational view of a portion of the pipe handling apparatus of the present invention illustrating the raised end of the pipe moved to a position overlying the rig floor.

As shown in FIG. 5, the trough portion 68 has a first end 72 and an opposing second end 74. The bracket portion 70 has a proximal end 76 connected to the first end 72 of the trough portion 68, a medial portion 78 pivotally connected to a pair of brackets 80 of the support frame 18 at a pivot point 82 located below the platform 20, and a distal end 84. The trough portion 68 is further supported in the lowered position by a pair of V-shaped support members 85 (FIG. 7) extending from the lower side of the platform 20 in alignment with the opening 52 of the platform 20. The second end 74 of the trough portion 68 of the carriage member 60 is provided with a pair or rollers 87 for rollingly supporting the first end 64 of the joint of pipe 14 in a manner to be discussed below.

Figure 4:
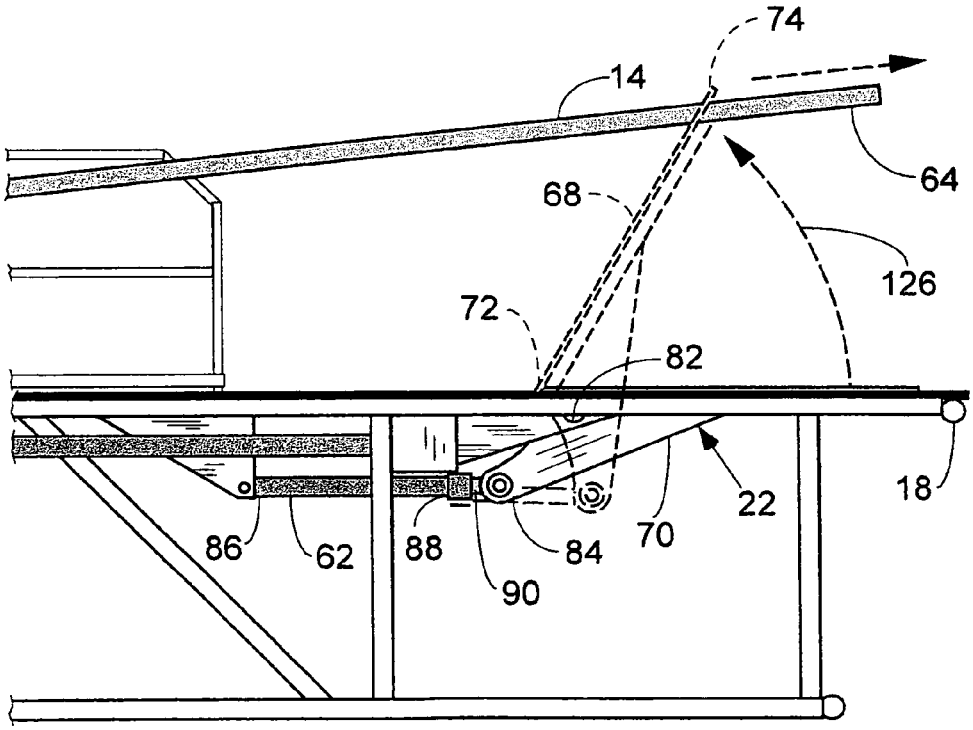
FIG. 4 is an enlarged side elevational view of a portion of the pipe handling apparatus of the present invention shown with the carriage member in the raised position.

The cylinder 62 has a first end 86, a second end 88, and a reciprocating rod 90 extending from the second end 88 of the cylinder 62. The first end 86 of the cylinder 62 is pivotally secured to the support frame 18 below the platform 20, and the distal end of the reciprocating rod 90 is pivotally connected to the distal end 84 of the bracket portion 70 of carriage member 60, as shown in FIGS. 4 and 5.

Referring now to FIGS. 1, 2, 8, 10, and 11, the pusher assembly 24 includes a pusher member 92 and a cylinder 94. The pusher member 92 is positioned in alignment with the pipe receiving groove 44 so as to be engageable with the second end 66 of the joint of pipe 14 when the joint of pipe 14 is positioned in the pipe receiving groove 44. The cylinder 94 functions to move the pusher member 92 along the pipe receiving groove 44 between a retracted position and an extended position. In the retracted position, the pusher member 92 is positioned near the second end 48 of the pipe receiving groove 44 to laterally support the joint of pipe 14 when the first end 64 of the joint of pipe 14 is elevated relative to the second end 66. In the extended position, the pusher member 92 is moved a selected distance away from the second end 48 of the pipe receiving groove 44 toward the first end 46 of the pipe receiving groove 44 so as to cause the second end 66 of the joint of pipe 14 to move through the pipe receiving groove 44 towards the first end 46 of the pipe receiving groove 44 along a substantially horizontal plane and thereby cause the first end 64 of the joint of pipe 14 to be moved to a position overlying the rig floor 16 (FIG. 5).

The pusher member 92 includes a semi-circular shaped pipe engaging portion 96 positioned above the platform 20 and a bracket 98 extending from the pipe engaging portion 96 down through the slot 51 of the platform 20. The pusher member 92 further includes a pair of rollers 100 for rollingly supporting the pusher member 92 on the platform 20.

The cylinder 94 has a first end 102, a second end 104, and a reciprocating rod 106 extending from the second end 104 of the cylinder 94. The cylinder 94 is secured to the support frame 18 below the platform 20 in a parallel relation to the pipe receiving groove 44 and the distal end of the reciprocating rod 106 is rigidly connected to a lower end of the bracket 98 of the pusher member 92.

Figure 2:
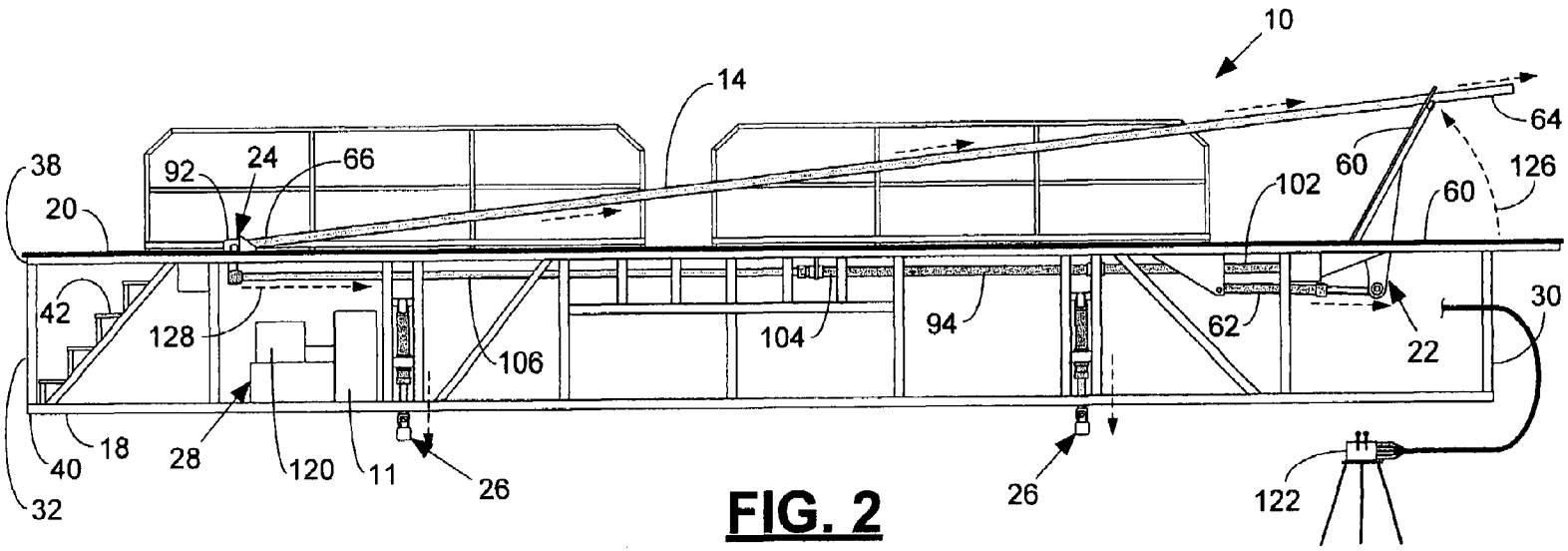
FIG. 2 is a side elevational view of the pipe handling apparatus of the present invention shown with the carriage member in a raised position.
Figure 3:
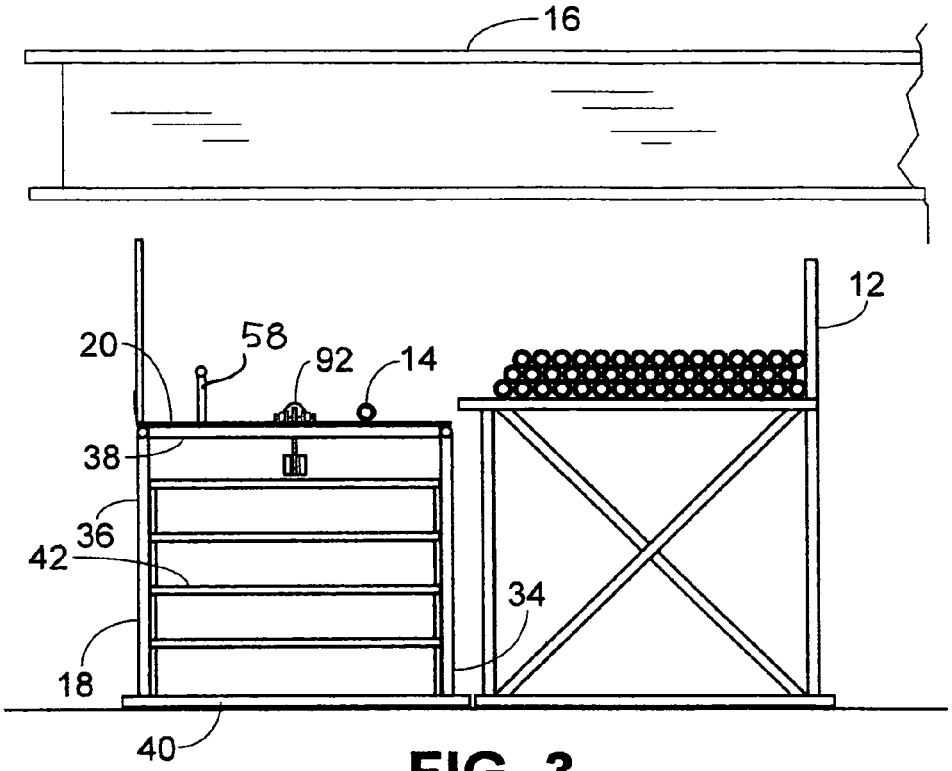
FIG. 3 is an end elevational view of the pipe handling apparatus of the present invention shown positioned adjacent a pipe storage rack and aligned with the center of a floor of a workover rig.
Figure 12:
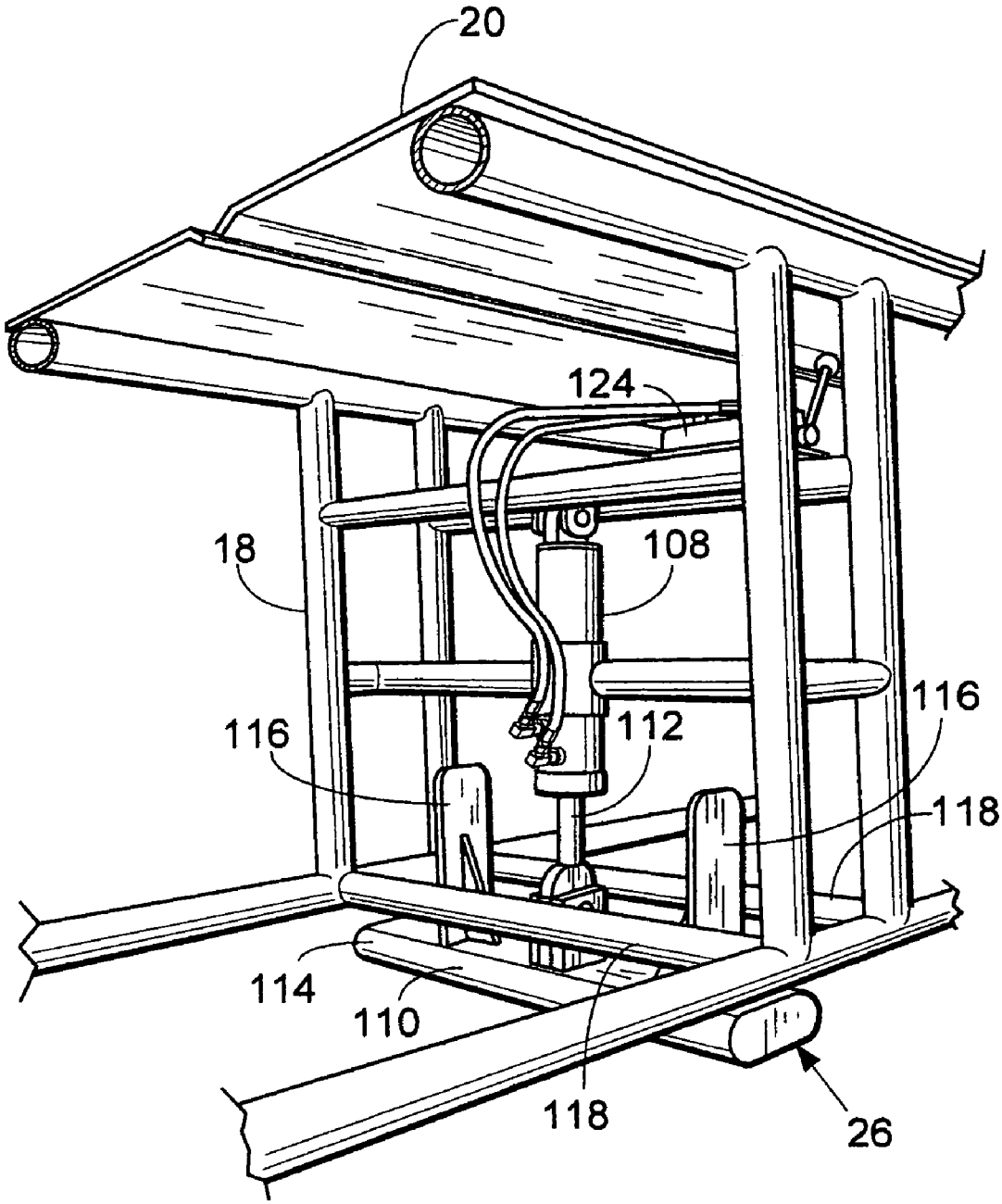
FIG. 12 is a perspective view of a jack assembly of the present invention.

Referring now to FIGS. 1, 2 and 12, each of the jack assemblies 26 is connected to the support frame 18 for selectively adjusting the height of the platform 20 relative to the height of the pipe storage rack 12 (FIG. 3). Each of the jack assemblies 26 includes a hydraulic cylinder 108 with a foot 110 provided on the end of a reciprocating rod 112 of the cylinder 108. The foot 110 is pivotally attached to the reciprocating rod 112 and includes a base member 114 and a pair of guide plates 116 extending upwardly therefrom. The foot 110 of the jack assemblies 26 swivels on the end of the reciprocating rod 112 and the guide plates 116 support the foot 110 between a pair of transverse support members 118 of the support frame 18. The jack assemblies 26 permit the platform 20 to be raised and lowered as desired. The height of the platform 20 is adjusted so that the platform 20 is lower than the level of the pipe racks 12 when the joint of pipe 14 is being rolled onto the platform 20 and the platform 20 is positioned above the level of the pipe racks 12 when the joint of pipe 14 is being rolled from the platform 20 to the pipe racks 12.

The cylinders 62, 94, and 108 can be any suitable cylinders known in the art, such as double-acting hydraulic cylinders. To this end, the hydraulic assembly 28 includes a hydraulic tank 119, an engine 120, and a control panel 122 which includes corresponding control valves for actuating each of the cylinders 62, 94. The cylinder 108 of jack assembly 26 is operated by a valve 124 mounted on the support frame 18 (FIG. 12). A 20 horsepower engine with a 9 gallon per minute capacity has been found to be suitable. The control panel 122 is preferably portable whereby a workman can position the control panel 122 in a convenient and safe location at the work site. Because the use of operation of hydraulic circuits are well known in the art, as well as their various components, the hosing used in the present invention has been omitted from the drawings for the sake of clarity.

OPERATION

The pipe handling apparatus 10 can be transported to the work site by any suitable means, such as a low-bed trailer or truck (not shown). With the pipe handling apparatus 10 transported to the work site, the pipe handling apparatus 10 is unloaded and positioned adjacent the pipe storage rack 12 in a parallel relationship to the joints of pipe 14 on the pipe storage rack 12 and adjacent the rig floor 16 with the pipe receiving groove 44 of the platform 20 in a substantially perpendicular relationship thereto. The height of the pipe handling apparatus 10 may then be adjusted, if necessary, to position the platform 20 at a height level with or slightly below the height of the pipe storage rack 12 to permit the joints of pipe 14 on the pipe storage rack 12 to be easily transported onto the platform 26 and into the pipe receiving groove 44 merely by rolling the individual joints of pipe 14. The height of the pipe handling apparatus 10 is adjusted by an operator actuating the cylinders 108 of the jack assemblies 26 so as to cause the reciprocating rods 112 and thus the foot 110 to be extended and thus raise the support frame 18 and the platform 20. Suitably sized support or blocking members (not shown), such as timbers, may then be positioned under the lower side 40 of the support frame 18. The reciprocating rods 112 of the jack assemblies 26 are then retracted so that the support frame 18 is supported on the support members. It will be appreciated that if the pipe handling apparatus 10 is being utilized to transport joints of pipe 14 from the rig floor 16 to the pipe storage rack 12, it will be desirable to position the platform 20 at a height level with or slightly above the height of the pipe storage rack 12 to permit the joints of pipe 14 on the platform 20 to be easily transported onto the pipe storage rack 12 merely by rolling the individual joints of pipe 14.

To transport a joint of pipe 14 from the pipe storage rack 12 to the rig floor 16, the carriage member 60 is positioned in the lowered position and the pusher member 92 is positioned in the retracted position. An operator then rolls the joint of pipe 14 (as shown in FIG. 3) onto the platform 20 and into the pipe receiving groove 44 so that the first end 64 of the joint of pipe 14 is positioned in the trough portion 68 of the carriage member 60 (FIG. 6). The operator then causes the cylinder 62 of the carriage assembly 22 to be actuated to extend the rod 90 and cause the carriage member 60 to be rotated about the pivot point 82 as represented by arrow 126 in FIGS. 2 and 4 and thus the trough portion 68 of the carriage member 60 to move to the raised position (FIGS. 2, 4, and 5) whereby the first end 64 of the joint of pipe 14 is elevated to a height at least the height of the rig floor 16 while the second end 66 of the joint of pipe 14 remains positioned in the pipe receiving groove 44.

The operator then causes the cylinder 94 of the pusher assembly 24 to be actuated to retract the rod 106 and cause the pusher member 92 to be moved along the pipe receiving groove 44 from the retracted position to the extended position, as represented by arrow 128 in FIG. 2, and thus cause the second end 66 of the joint of pipe 14 to move through the pipe receiving groove towards the first end 46 of the pipe receiving groove 44 along a substantially horizontal plane and thereby cause the first end 64 of the joint of pipe 14 to be moved to a position overlying the rig floor 16 (FIG. 5). With the first end 64 of the joint of pipe 14 overlying the rig floor 16, the carriage member 60 may be moved to the lowered position thereby lowering the first end 64 of the joint of pipe 14 onto the rig floor 16 where operators on the rig floor 16 can latch onto the first end 64 of the joint of pipe 14 with the elevators (not shown) of the rig and lift the joint of pipe 14 onto the rig floor 16. The pusher member 92 is then returned to the retracted position to receive another joint of pipe 14.

When the pipe handling apparatus 10 is employed to remove a joint of pipe 14 from the rig floor 16, the first end 64 of the joint of pipe 14 is positioned on the carriage member 60 with the carriage member 60 in the raised position and the second end 66 of the joint of pipe 14 is positioned in engagement with the pusher member 92 with the pusher member 92 in the extended position. The pusher member 92 is then moved to the retracted position whereby the weight of the joint of pipe 14 causes the joint of pipe 14 to slide along the pipe receiving groove 44 and over the rollers 87 of the carriage member 60 toward the second end 48 of the pipe receiving groove 44. The carriage member 60 is the moved to the lowered position and the joint of pipe 14 transferred to the pipe storage rack 12.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A pipe handling apparatus for transporting pipe to and from a rig floor, the pipe handling apparatus comprising:

a platform having a pipe receiving groove formed therein, the pipe receiving groove having a first end and an opposing second end, the platform forming a substantially flat, continuous surface extending along each side of the pipe receiving groove from a first end of the platform to a second end of the platform so as to permit an individual to walk along the length of the pipe receiving groove on either side of the pipe receiving groove while the pipe is being transported to and from the rig floor;

a carriage member positioned in alignment the pipe receiving groove, the carriage member movable between a lowered position wherein the pipe positioned in the pipe receiving groove of the platform is supported in a substantially parallel relationship with respect to the platform and a raised position wherein the carriage member supports a first end of the pipe at an elevated position relative to an opposing second end of the pipe; and a pusher member aligned with the pipe receiving groove so as to be engageable with the second end of the pipe when the pipe is positioned in the pipe receiving groove, the pusher member movable along the pipe receiving groove so as to cause the second end of the pipe to move along the pipe receiving groove such that the first end of the pipe moves toward the rig floor when the pusher member moves toward the first end of the pipe receiving groove with the carriage member in the raised position supporting the first end of the pipe and such that the first end of the pipe moves away from the rig floor when the pusher member is moved away from the first end of the pipe receiving groove with the carriage member in the raised position supporting the first end of the pipe.

2. The pipe handling apparatus of claim 1 wherein the platform further has an elongated slot extending through the plate and in a parallel relationship with respect to the pipe receiving groove, wherein the pusher member includes a pipe engaging portion positioned above the platform and a bracket extending from the pipe engaging portion down through the slot, and wherein the pipe handling apparatus further comprises:

a first cylinder having a first end, a second end, and a reciprocating rod extending from the second end of the cylinder, the first cylinder supported below the platform in a parallel relation to the pipe receiving groove and the reciprocating rod connected to the bracket of the pusher member; and means for selectively actuating the rod of the first cylinder between a first position wherein the pusher member is positioned near the second end of the pipe receiving groove and a second position wherein the pusher member is positioned toward the first end of the pipe receiving groove.

3. The pipe handling apparatus of claim 2 wherein the pipe engaging portion is rollingly supported on the platform.

4. The pipe handling apparatus of claim 1 wherein the platform further has a carriage receiving opening in communication with the pipe receiving groove, wherein the carriage includes a trough portion positioned in the carriage receiving opening when the carriage is in the lowered position and a bracket portion, the trough portion having a first end and an opposing second end, the bracket portion having a proximal end connected to the first end of the trough portion, a medial portion pivotally supported below the platform, and a distal end, and wherein the pipe handling apparatus further comprises:

a second cylinder having a first end, a second end, and a reciprocating rod extending from the second end of the cylinder, the second cylinder pivotally secured below the platform and the reciprocating rod pivotally connected to the distal end of the bracket portion of carriage; and means for selectively actuating the rod of the second cylinder between a first position wherein the carriage is positioned in the lowered position and a second position wherein the carriage is rotated so as to cause the second end of the trough portion of the carriage to be moved to the raised position.

5. The pipe handling apparatus of claim 4 wherein the trough portion is substantially V-shaped.

6. The pipe handling apparatus of claim 4 wherein the second end of the trough portion is provided with a pair of rollers for rollingly supporting the pipe when the carriage is in the raised position and the pusher member is moving along the pipe receiving groove.

7. The pipe handling apparatus of claim 1 further comprising:

a plurality of jack assemblies for selectively adjusting the height of the platform relative to the height of the pipe storage rack.

8. The pipe handling apparatus of claim 1 wherein the platform further comprises a hand rail extending upwardly from at least one of a first side and a second side of the platform.

9. The pipe handling apparatus of claim 1 wherein the platform further has a plurality of holes adjacent the pipe receiving groove on each side of the pipe receiving groove, and wherein the pipe handling apparatus further comprises:

a plurality of stop members positioned in the holes of the platform on the side of the pipe receiving groove opposite the pipe storage rack and extending upwardly from the platform to prevent the pipe from rolling through the pipe receiving groove.

10. A pipe handling apparatus for transporting pipe to and from a rig floor, the pipe handling apparatus comprising:

a platform having a pipe receiving groove formed therein, the pipe receiving groove having a first end and an opposing second end, the platform forming a substantially continuous surface along at least one side of the pipe receiving groove so as to permit an individual to walk along the length of the pipe receiving groove while the pipe is being transported to and from the rig floor;

a carriage member positioned in alignment with the pipe receiving groove, the carriage member movable between a lowered position wherein the pipe positioned in the pipe receiving groove of the platform is supported in a substantially parallel relationship with respect to the platform and a raised position wherein the carriage member supports a first end of the pipe at an elevated position relative to an opposing second end of the pipe; and a pusher member aligned with the pipe receiving groove so as to be engageable with the second end of the pipe when the pipe is positioned in the pipe receiving groove, the pusher member movable along the pipe receiving groove so as to cause the second end of the pipe to move along the pipe receiving groove such that the first end of the pipe moves toward the rig floor when the pusher member moves toward the first end of the pipe receiving groove with the carriage member in the raised position supporting the first end of the pipe and such that the first end of the pipe moves away from the rig floor when the pusher member is moved away from the first end of the pipe receiving groove with the carriage member in the raised position supporting the first end of the pipe.

11. The pipe handling apparatus of claim 10 wherein the platform further has an elongated slot extending through the plate and in a parallel relationship with respect to the pipe receiving groove, wherein the pusher member includes a pipe engaging portion positioned above the platform and a bracket extending from the pipe engaging portion down through the slot, and wherein the pipe handling apparatus further comprises:

a first cylinder having a first end, a second end, and a reciprocating rod extending from the second end of the cylinder, the first cylinder supported below the platform in a parallel relation to the pipe receiving groove and the reciprocating rod connected to the bracket of the pusher member; and means for selectively actuating the rod of the first cylinder between a first position wherein the pusher member is positioned near the second end of the pipe receiving groove and a second position wherein the pusher member is positioned toward the first end of the pipe receiving groove.

12. The pipe handling apparatus of claim 11 wherein the pipe engaging portion is rollingly supported on the platform.

13. The pipe handling apparatus of claim 10 wherein the platform further has a carriage receiving opening in communication with the pipe receiving groove, wherein the carriage includes a trough portion positioned in the carriage receiving opening when the carriage is in the lowered position and a bracket portion, the trough portion having a first end and an opposing second end, the bracket portion having a proximal end connected to the first end of the trough portion, a medial portion pivotally supported below the platform, and a distal end, and wherein the pipe handling apparatus further comprises:

a second cylinder having a first end, a second end, and a reciprocating rod extending from the second end of the cylinder, the second cylinder pivotally supported below the platform and the reciprocating rod pivotally connected to the distal end of the bracket portion of carriage; and means for selectively actuating the rod of the second cylinder between a first position wherein the carriage is positioned in the lowered position and a second position wherein the carriage is rotated so as to cause the second end of the trough portion of the carriage to be moved to the raised position.

14. The pipe handling apparatus of claim 13 wherein the trough portion is substantially V-shaped.

15. The pipe handling apparatus of claim 13 wherein the second end of the trough portion is provided with a pair of rollers for rollingly supporting the pipe when the carriage is in the raised position and the pusher member is moving along the pipe receiving groove.

16. The pipe handling apparatus of claim 10 further comprising:

a plurality of jack assemblies for selectively adjusting the height of the platform relative to the height of the pipe storage rack.

17. The pipe handling apparatus of claim 10 wherein the platform further comprises a hand rail extending upwardly from at least one of a first side and a second side of the platform.

18. The pipe handling apparatus of claim 10 wherein the platform further has a plurality of holes adjacent the pipe receiving groove on each side of the pipe receiving groove, and wherein the pipe handling apparatus further comprises:

a plurality of stop members positioned in the holes of the platform on one side of the pipe receiving groove and extending upwardly from the platform to prevent the pipe from rolling through the pipe receiving groove.

* * * * *